US006003346A

United States Patent [19]

Hsu

[11] Patent Number: 6,003,346

[45] Date of Patent: Dec. 21, 1999

[54] BEAKER FOR SAMPLE DYEING MACHINE AND SAMPLE DYEING

[76] Inventor: Min-Chung Hsu, 8th Fl., No. 11, Lane 158, Hsingyi Rd., Taipei, Taiwan

[21] Appl. No.: 09/097,750

[22] Filed: Jun. 16, 1998

[51] Int. Cl.[6] ..... D06B 5/18

[52] U.S. Cl. ..... 68/150; 68/151; 68/156; 68/170; 68/207

[58] Field of Search ..... 68/148, 150–157, 68/159, 165, 170–174, 189, 207

[56] References Cited

U.S. PATENT DOCUMENTS

| | | | |
|---|---|---|---|
| 3,379,038 | 4/1968 | Blancafort | 68/156 |

FOREIGN PATENT DOCUMENTS

| | | | |
|---|---|---|---|
| 754117 | 1/1971 | Belgium | 68/152 |
| 253739 | 2/1970 | U.S.S.R. | 68/156 |
| 1429838 | 3/1976 | United Kingdom . | |

*Primary Examiner*—Philip R. Coe
*Attorney, Agent, or Firm*—William E. Pelton, Esq.

[57] ABSTRACT

A beaker for a sample dyeing machine comprises a hollow beaker body and a longitudinal sliding cylinder with flanges on both its ends. The outer wall of the cylinder is uniformly perforated for wrapping of a sample yarn or cloth to be dyed. A plurality of grooves is separately formed on the periphery of either one of the flanges to guide the flow of a dye solution. An annular passage is formed in the interior of the cylinder from one end to the other for allowing a dye solution to flow between the passage and the perforated wall of the cylinder. The beaker thus constructed can dye a sample uniformly and efficiently due to sufficient contact between a sample and a dye solution. The beaker also comprises a hollow tube outside the beaker body for one-way flow of a dye solution, and/or a dispensing device screwed on the top thereof for liquid addition to the beaker. A sample dyeing machine comprises a plurality of the beakers in a fixed rack. Under the rack is a magnetic plate having a plurality of strong magnets so separately arranged on the plate that the pole of each magnet is opposite to that of adjacent magnets. The cylinders inside the beakers are moved up and down by magnetic force while the magnetic plate is slid back and forth on a screw driven by a motor.

12 Claims, 18 Drawing Sheets

BEAKER FOR SAMPLE DYEING MACHINE AND SAMPLE DYEING

BACKGROUND OF THE INVENTION

1. Field of the Invention

The present invention relates to a beaker for a sample dyeing machine, in which a cylinder is placed inside the beaker. The beaker thus constructed can dye a sample uniformly and efficiently due to sufficient contact between the sample and the dye solution. The present invention also relates to a sample dyeing machine which can drive the cylinder in the beaker by magnetic force.

2. Description of the Prior Arts

It is well known that each type of textile or fabric requires unique processing procedures. In the case of dyeing procedures, it is desirable to dye a series of test lots of each material on a small scale so as to determine the optimal processing parameters before production is undertaken on a large scale. Several kinds of sample dyeing machines suitable for laboratories have been developed to allow an artisan to gather useful information in the light of the test dyeing results. A material to be dyed, such as a yarn or cloth, is usually put into a beaker containing a liquid such as a dye solution, a fixing agent, or the like. After closing the beaker, the beaker is shaken or rotated in order to bring the material into as uniform contact with the liquid as possible and to obtain accurate coloration for reference.

FIG. 1 shows a longitudinal cross-section of a conventional beaker, which substantially comprises a beaker body 1 and a lid 2. A helical rack 3 is installed in the beaker, on which a sample yarn or cloth 4 to be dyed is wrapped. FIG. 2 illustrates the steps of wrapping a sample yarn for insertion into a conventional beaker. First, a yarn 4 is wrapped on a palm with fingers closed. Then, transfer the wrapped yarn 4 onto the helical rack 3 while opening the fingers. Finally, the helical rack 3 wrapped with the yarn 4 is put into the beaker body 1 for dyeing treatment. Said helical rack 3 may be in the form of a spring. By means of shaking or rotating the beaker, a dye solution or a desirable liquid is supposed to impregnate the interior of the yarn.

There is, however, a drawback of the above beaker structure. Simply by means of shaking or rotating the beaker, a dye solution randomly flows in the space enclosed by the beaker body and the lid. Moreover, in view of the ratio of liquid to solid, one part of material to be dyed is usually in contact with about ten parts, for example, of a dye solution. The capacity within the space enclosed by the beaker body and the lid is usually from about 300 c.c. to 400 c.c. but the amount of a dye solution added is usually only about 100 c.c. Therefore, a dye solution is just splashed onto the yarn surface when shaking or rotating the beaker so that it is difficult to sufficiently dye the interior of a yarn in a short time, resulting in a dyed yarn with poor uniformity in coloration.

On the other hand, a controlled addition of additive and/or a dye solution into a beaker at a selected time is also desirable in order to control a uniform dyeing. In case of a conventional sample dyeing machine as shown in FIG. 3, several beakers (beaker bodies 1 with lids 2) are arranged along the periphery of a circular disk 5 in such a manner that their longitudinal axes extend slanted in different planes with respect to the axis of rotation of the circular disk 5. A dye solution flows more irregularly in those beakers while rotating so it is not confirmed whether a yarn or cloth to be dyed is thoroughly impregnated. Besides, it is difficult to dispense a liquid to selected beakers while they are moving.

OBJECTS AND SUMMARY OF THE INVENTION

Thus, it is a object of the present invention to provide a beaker for a sample dyeing machine, with which the aforementioned drawback is eliminated. It is also a object of the present invention to provide a sample dyeing machine, with which the aforementioned drawback is eliminated. A further object of the present invention is to provide a sample dyeing machine, in which a beaker according to the present invention can be installed to achieve high performance.

According to one aspect of the present invention, a beaker for a sample dyeing machine comprises a hollow beaker body and a longitudinal sliding cylinder with flanges on both ends. The outer wall of the cylinder is uniformly perforated for wrapping of a sample yarn or cloth to be dyed. A plurality of grooves is separately formed on the periphery of either one of the flanges to guide the flow of a dye solution. An annular passage is formed in the interior of the cylinder from one end to the other for allowing a dye solution to flow between the passage and the perforated wall of the cylinder. The beaker thus constructed can dye a sample uniformly and efficiently due to sufficient contact between a sample and the dye solution.

The beaker above mentioned may further comprise a hollow tube outside said beaker body for one-way flow of a dye solution, and/or a dispensing device screwed on the top thereof for liquid addition to the beaker without interrupting the movement of the cylinders in the beakers.

According to another aspect of the present invention, a sample dyeing machine comprises a plurality of said beakers in a fixed rack. Under said rack is a magnetic plate having a plurality of strong magnets so separately arranged on said plate that the poles of each said magnet is opposite to that of adjacent magnets. The cylinders inside said beakers are moved up and down by magnetic force while said magnetic plate is slid back and forth on a screw driven by a motor. Hence, a dye solution in the beaker can flow more regularly in a desired manner, and it is much easier to add a liquid into the fixed beakers.

By means of such a beaker and a sample dyeing machine, a uniform dyeing in a sample can be attained.

BRIEF DESCRIPTION OF THE DRAWINGS

The present invention will be better understood and the above objects will become apparent when attention is given to the following description and read in conjunction with the appended drawings, wherein.

DETAILED DESCRIPTION OF THE PREFERRED EMBODIMENTS OF THE INVENTION

Figure 1:
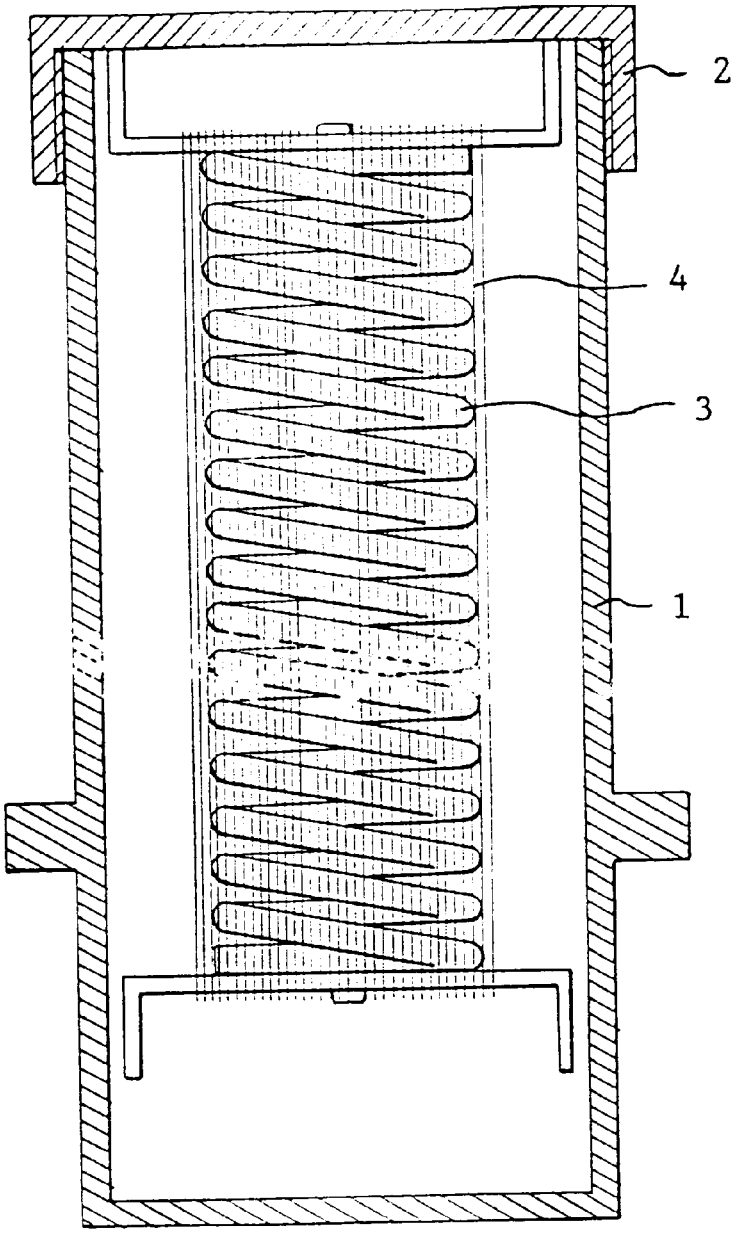
FIG. 1 PRIOR ART
FIG. 1 shows a longitudinal cross-section of a conventional beaker.
Figure 2:
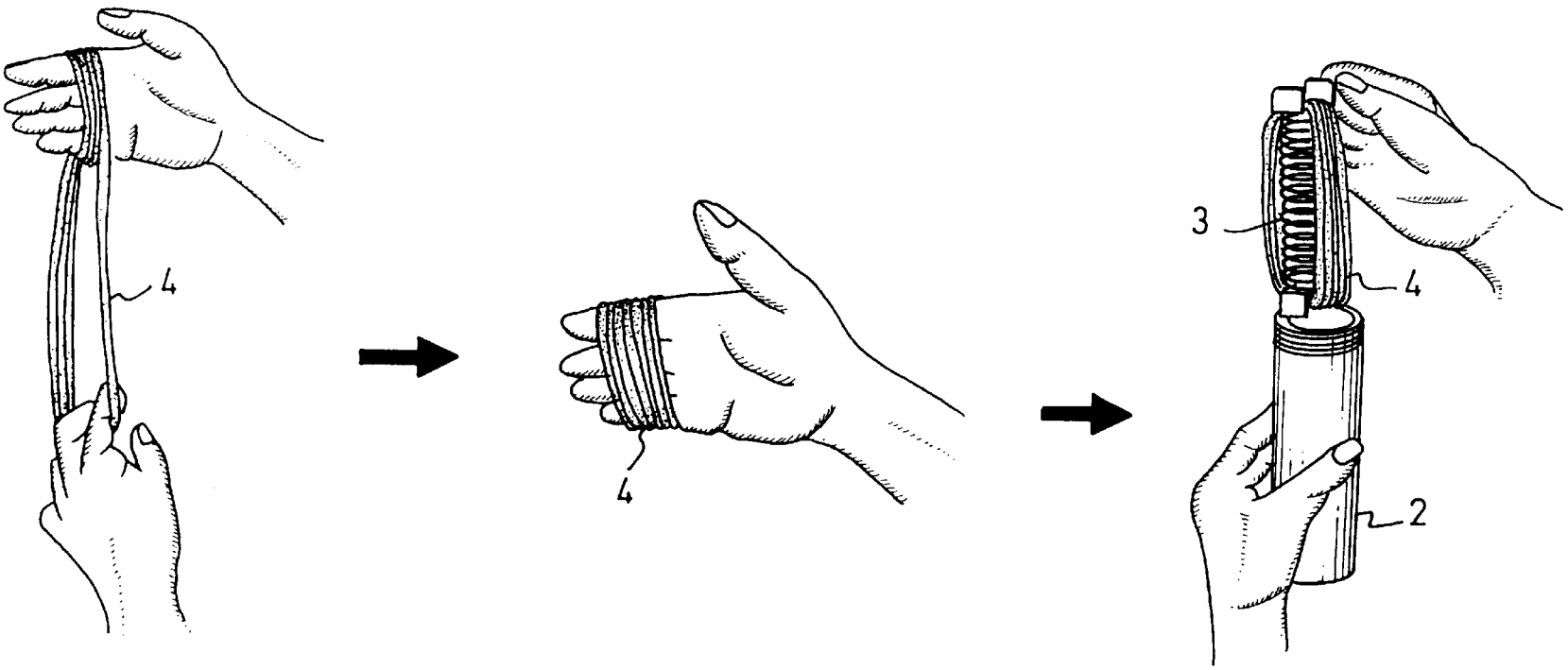
FIG. 2 PRIOR ART
FIG. 2 illustrates the steps of wrapping a sample yarn for insertion into a conventional beaker.
Figure 3:
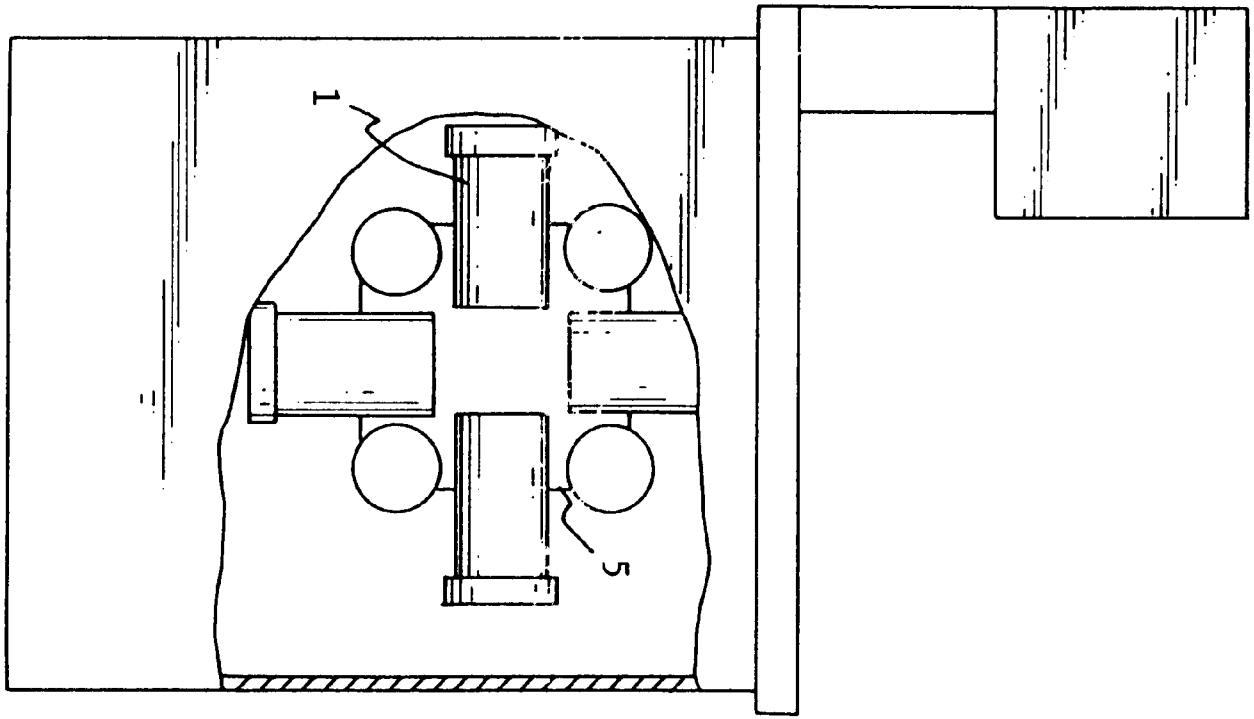
FIG. 3 PRIOR ART
FIG. 3 is a partially cutaway side view of a conventional sample dyeing machine.
Figure 4A:
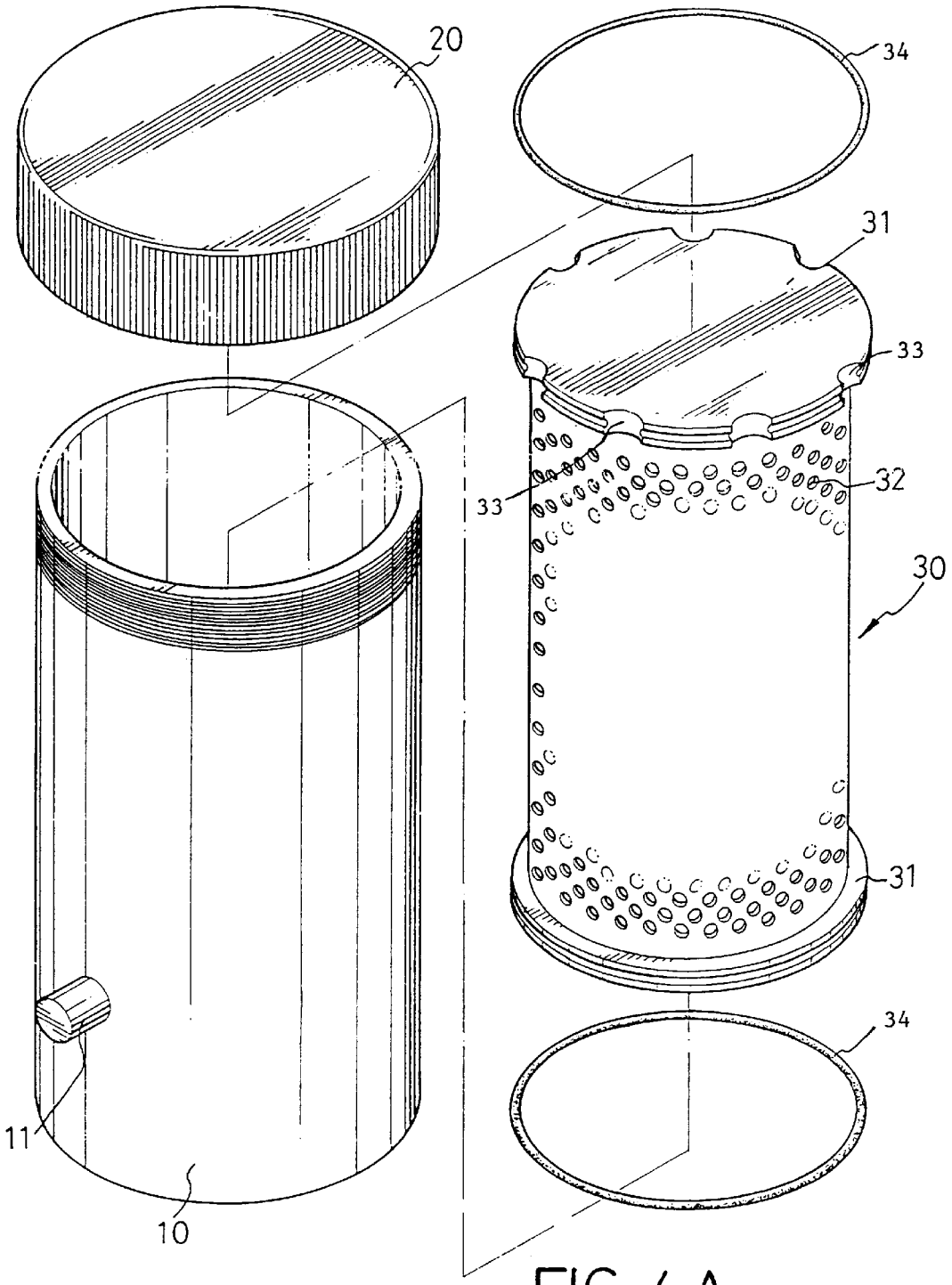
FIGS. 4A and 4B are two exploded views of the beakers according to the embodiments of the present invention.

According to one of the preferred embodiments of the present invention, the beaker for a sample dyeing machine illustrated in FIG. 4A includes a hollow beaker body 10 for containing a dye solution, and a lid 20 screwed to said beaker body 10, which move together when installed in a sample dyeing machine. The beaker may further comprise a set of stems 11 on the outer wall of said beaker body 10 for fixing the beaker in a sample dyeing machine.

Figure 4B:
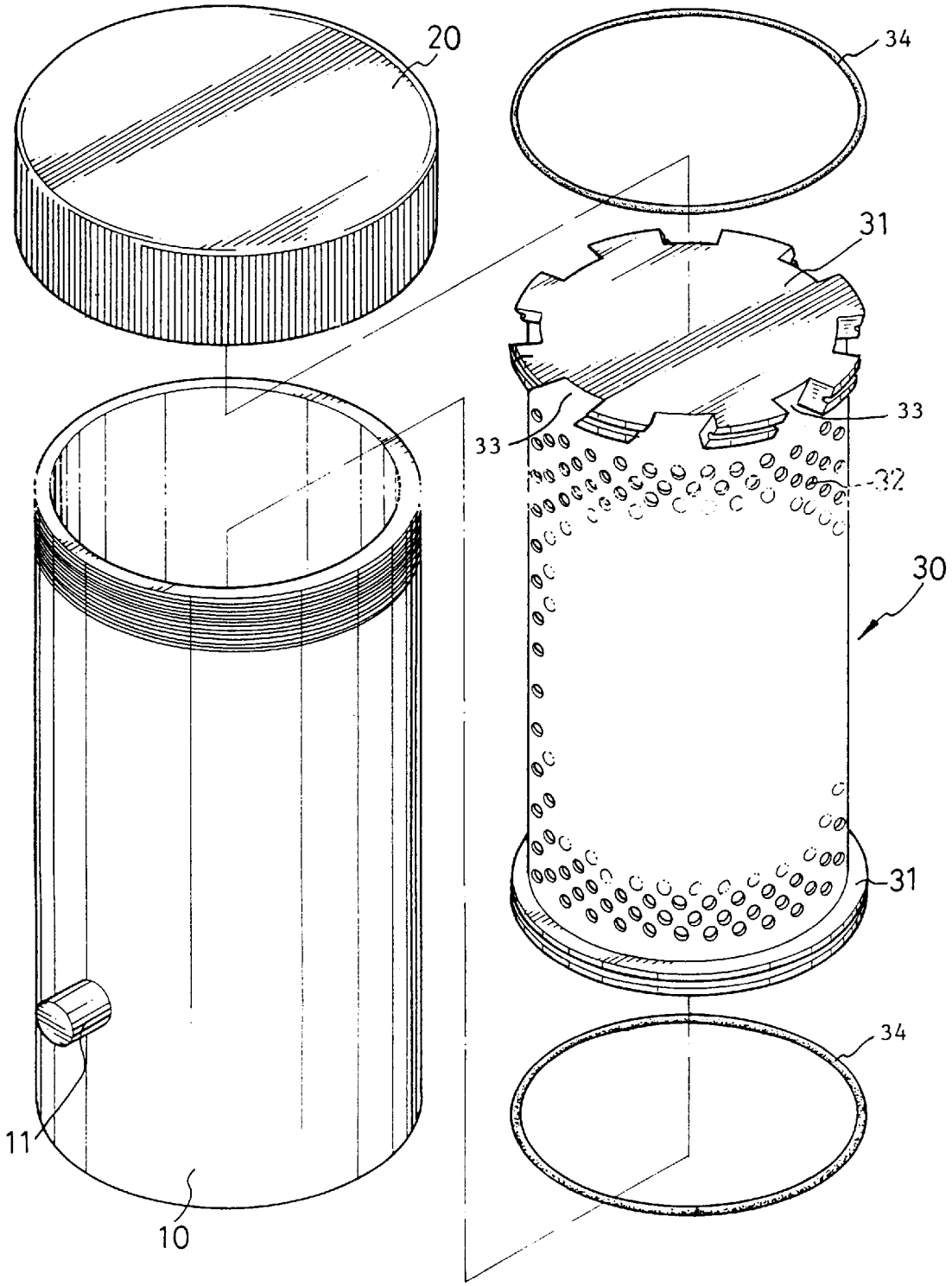

Inside said beaker body 10 is placed a longitudinal sliding cylinder 30 with flanges 31 on its both ends, wherein the outer wall 32 of said cylinder 30 is uniformly perforated. A sample yarn or cloth for dyeing will be wrapped on the perforated wall 32. A plurality of grooves 33 parallel to the longitudinal axis of said cylinder 30 is separately formed on the periphery of either one of the flanges 31 to guide the flow of a dye solution inside the beaker body 10 while installed in a sample dyeing machine and operated. Referring to FIG. 4B, the longitudinal direction of said grooves 33 on the flange 31 of the cylinder 30 may be tilted relative to the longitudinal axis of said cylinder 30. Guided by those tilt grooves 33, a dye solution in the beaker thus constructed will flow rotationally so as to further increase the possibility of contact with the sample.

In addition, each said flange 31 of the cylinder 30 may further comprise a ring 34 on its circumference. The ring 34 can be positioned between said flange 31 and the inner wall of said beaker body 10 to make the cylinder 30 slide more smoothly inside the beaker body 10. Furthermore, an annular passage 35 (not shown in FIGS. 4A and 4B) is formed in the interior of said cylinder 30 from one end to the other for allowing a dye solution to flow between said passage 35 and the perforated wall 32 of said cylinder 30.

Figure 5A:
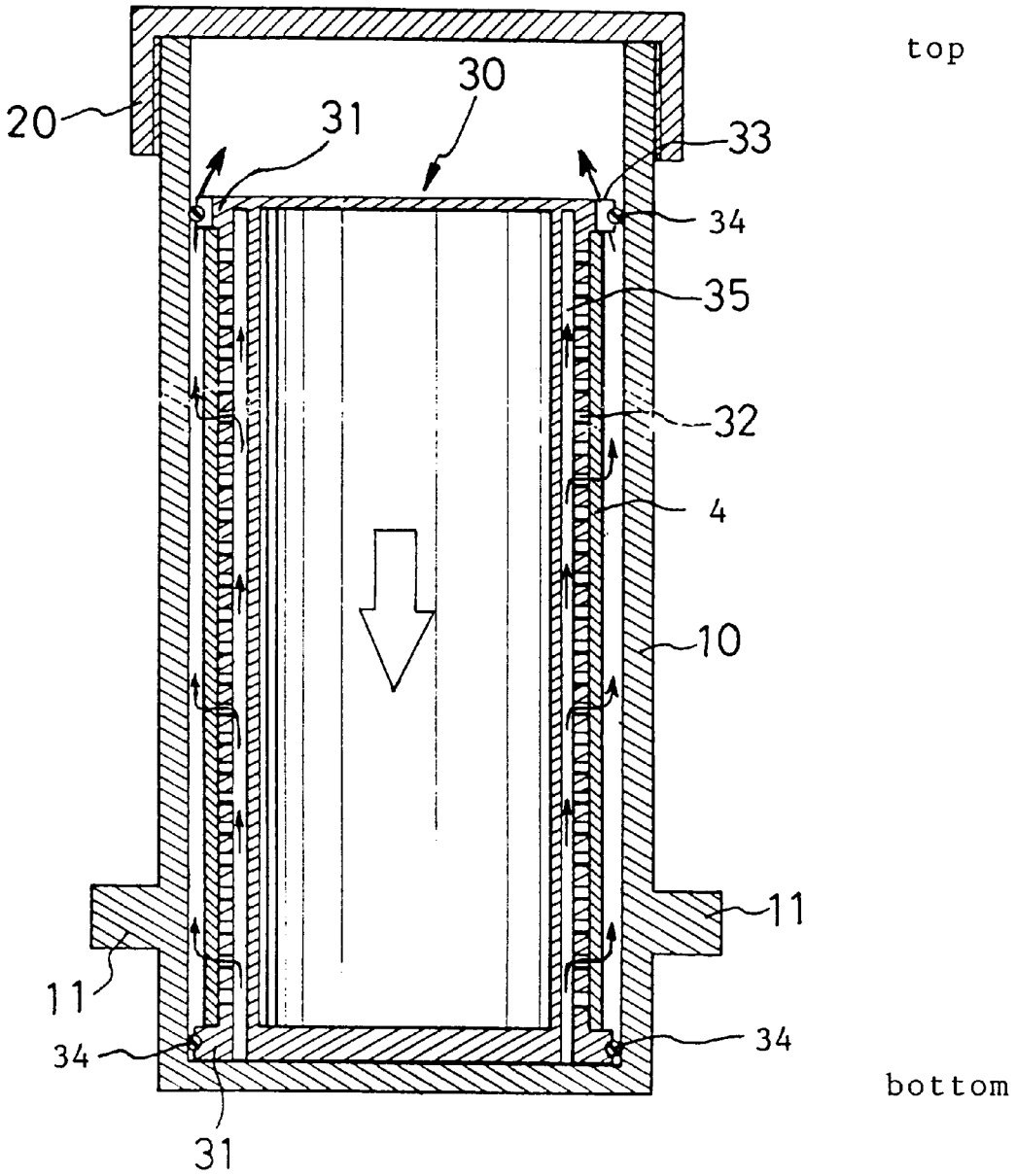
FIGS. 5A and 5B shows two longitudinal cross-sections of the beakers shown in FIG. 4 with up-side-up and with up-side-down, respectively.
Figure 5B:
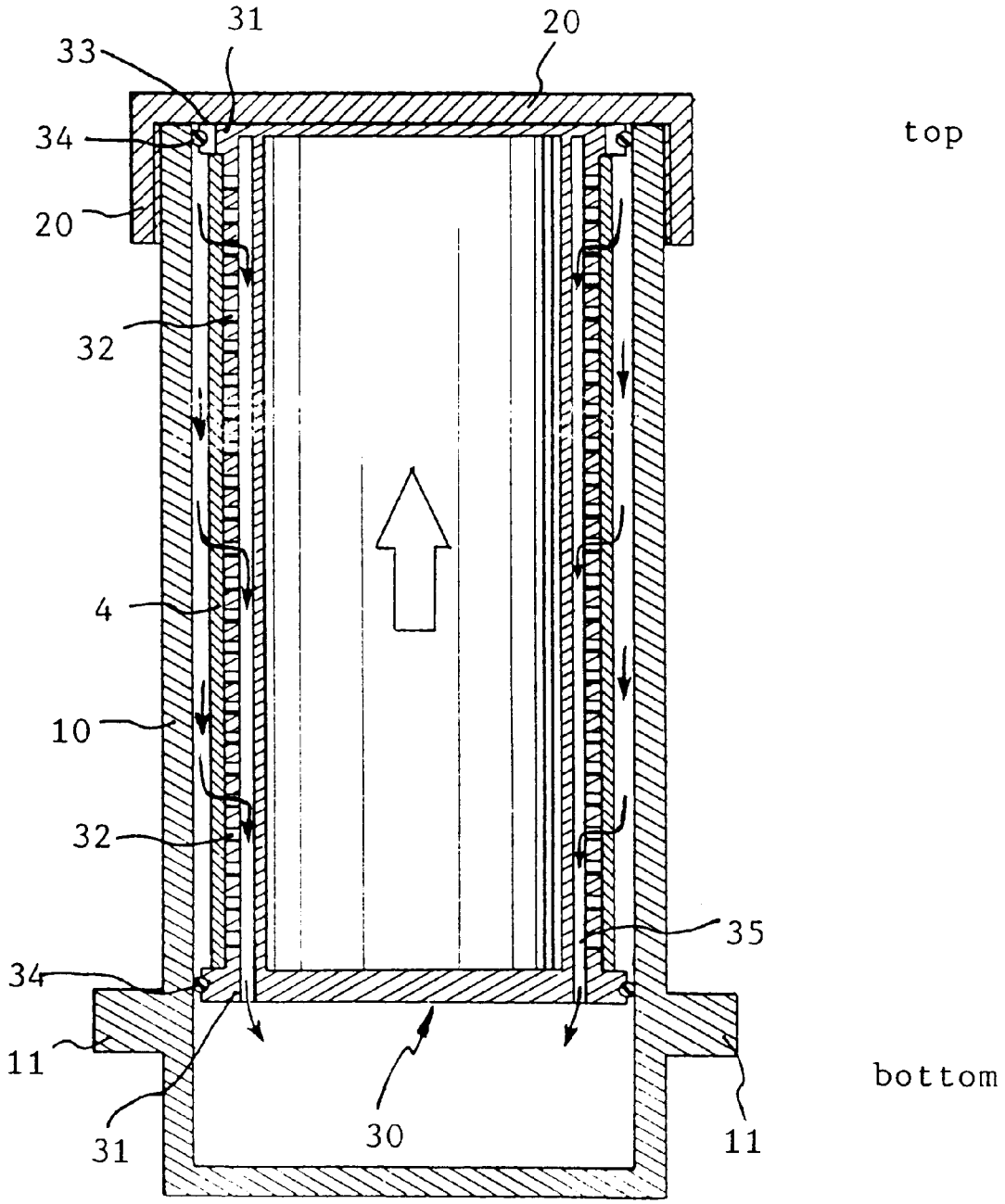

FIGS. 5A and 5B shows two longitudinal cross-sections of the beakers shown in FIG. 4 with the cylinder 30 moving inside the beaker body 10. When the cylinder 30 slides downward relative to the beaker body 10 as shown in FIG. 5A, the liquid is repelled by the larger volume of the cylinder 30 and flows upward, as shown by the arrows, wherein it passes into the annular passage 35, then sequentially penetrates the perforated wall 32 and the material 4 for dyeing into the space between the inner wall of the beaker body 10 and a material 4, and finally gathers in the upper vacant portion of the beaker body 10 through the grooves 33. When the cylinder 30 slides upward relative to the beaker body 10 as shown in FIG. 5B, the liquid flows in a manner reverse to the aforementioned. Thus, the liquid must infiltrate the material 4 either from the interior to the exterior or from the exterior to the interior whenever the cylinder 30 is moving up or down.

Figure 6:
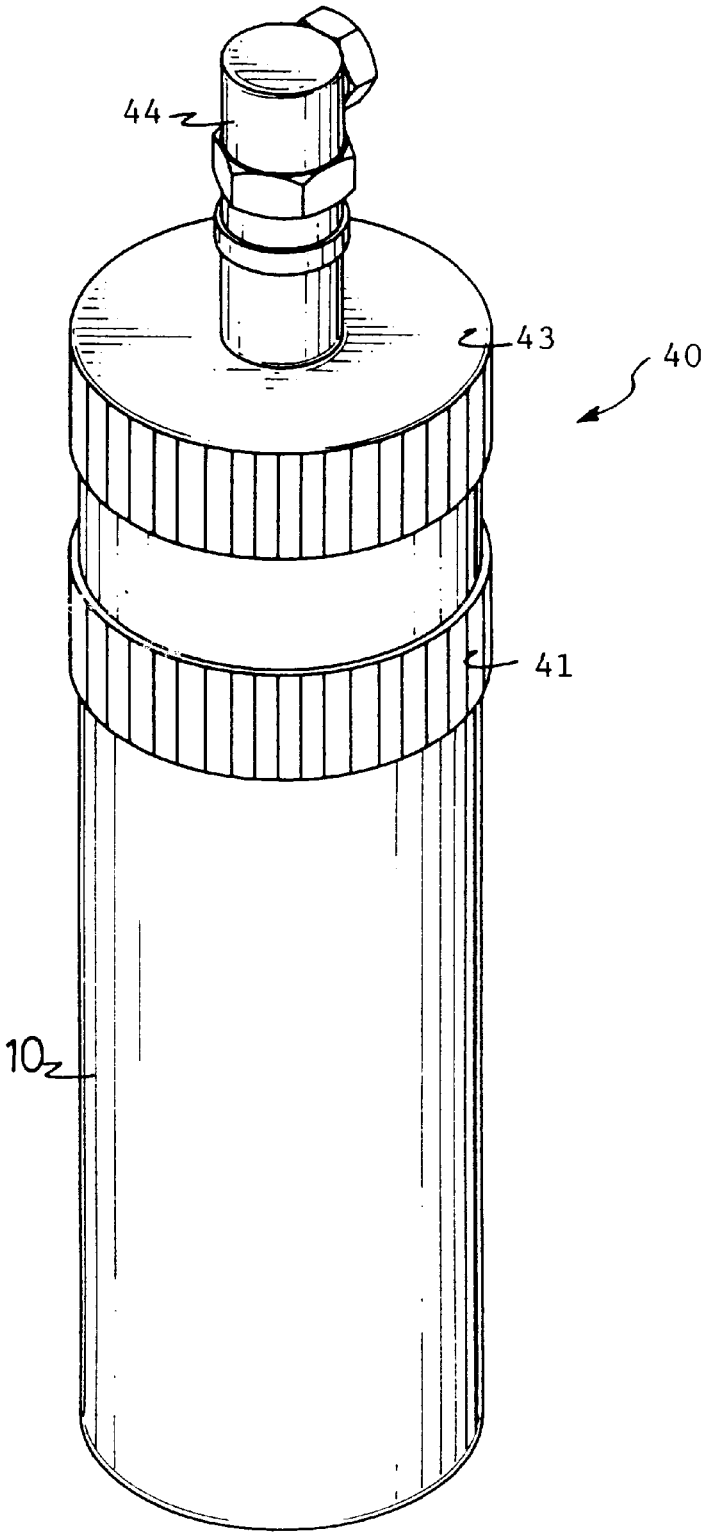
FIG. 6 is a perspective view of the beaker according to one of the preferred embodiments of the present invention.

In accordance with another one of the preferred embodiments of the present invention, the beaker for a sample dyeing machine further comprises a dispensing device 40, as shown in FIG. 6, screwed on the top thereof for liquid addition to said beaker body 10. The aforementioned lid 20 of the beaker is unnecessary when the dispensing device 40 is installed.

Figure 7:
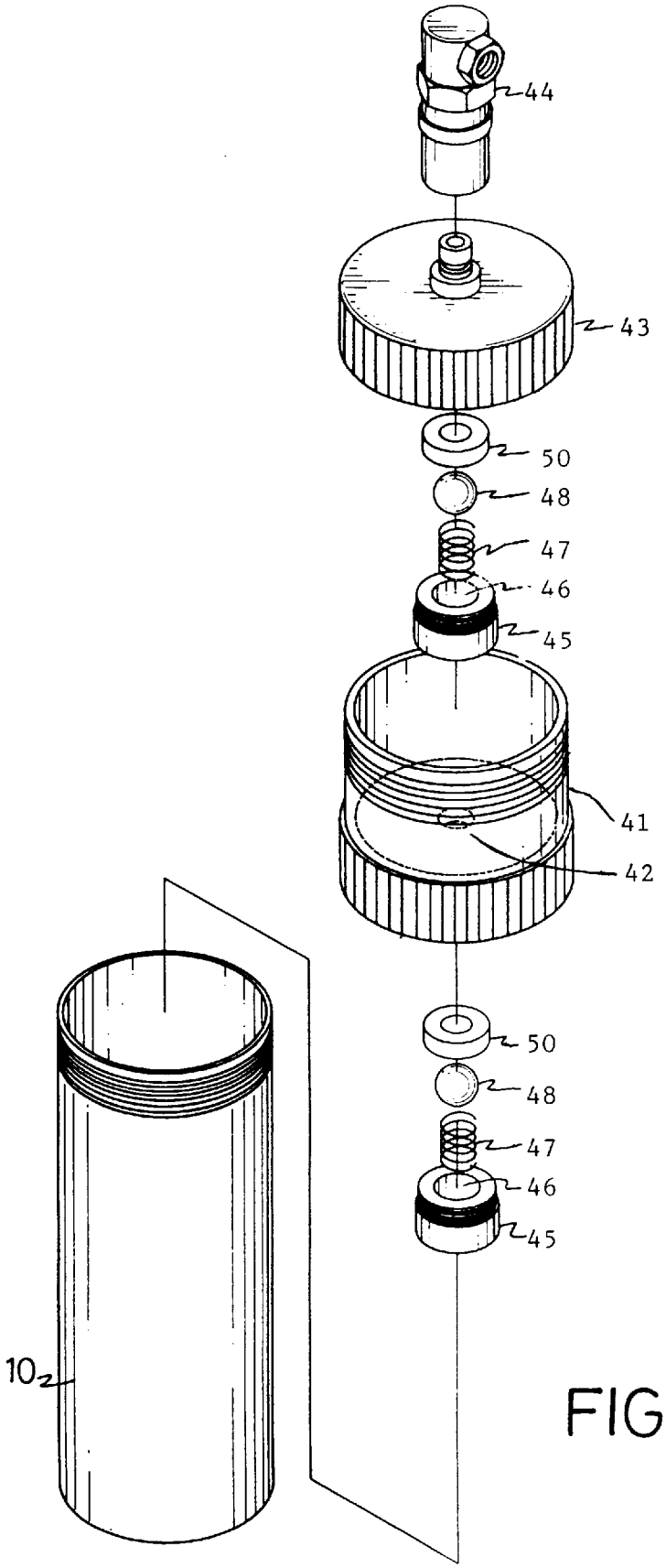
FIG. 7 is an exploded view of the beaker shown in FIG. 6.
Figure 8:
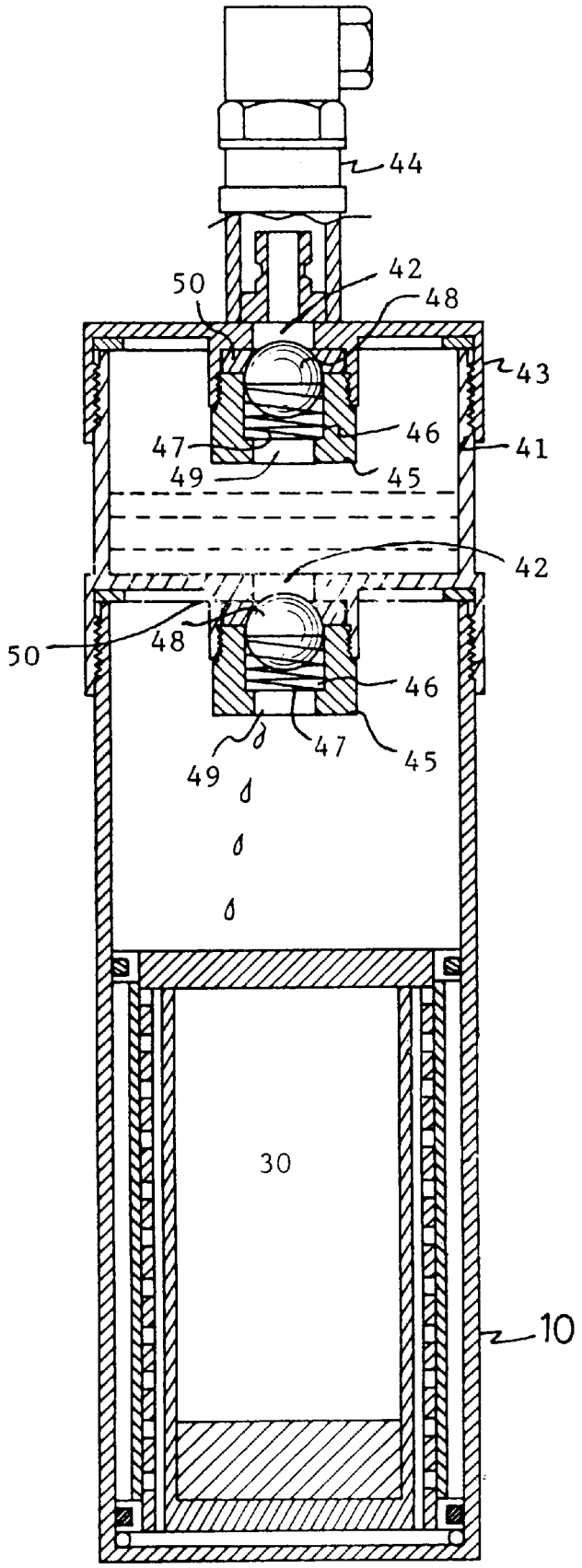
FIG. 8 is a longitudinal cross-section of the beaker shown in FIGS. 6 and 7.

Referring to FIGS. 7 and 8, said dispensing device 40 comprises a cup 41 for containing a liquid having a through hole 42 formed in the center of its bottom, a cup cover 43 screwed on the top of said cup 41, and a joint 44 installed on the top of said cup cover 43 for gas injection by pressure. A locking block 45 is screwed beneath the bottom of said cup 41. A cavity 46 is formed at the center of said locking block 45. A spring 47 and a steel ball 48 are sequentially placed inside said cavity 46 from bottom to top. A recess hole 49 is formed at the bottom of said cavity 46 and connected with the through hole 42 formed on the center of the cup 41 bottom to allow a liquid to flow from said cup 41 into the beaker body 10.

Moreover, said cup cover 43 of the dispensing device 40 may also comprise a through hole 42, a locking block 45, a cavity 46, a spring 47 and a steel ball 48, and a recess hole 49 all constructed and assembled in the same manner as in said cup 41. The recess hole 49 formed at the bottom of the cavity 46 of the locking block 45 of the cup cover 43 is connected with said joint 44 installed on the top of the cup cover 43 to allow a pressurized gas to flow from said joint 44 into the cup cover 43 so that a liquid contained in the cup 41 will be displaced into the beaker body 10 via the through hole 42 formed on the bottom of the cup 41. Furthermore, said dispensing device 40 may further comprise an O-ring or a washer 50 placed between said locking block 45 and said cup 41 or cup cover 43 thereof in order to provide a seal between the locking block 45 and the cup 41 or cup cover 43.

Figure 9B:
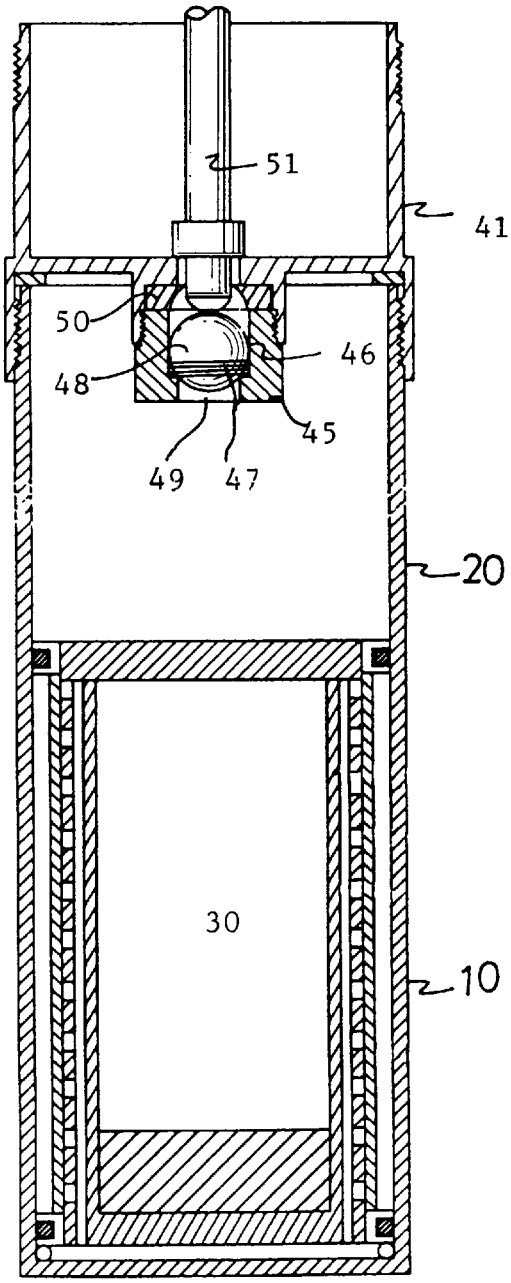
FIGS. 9A and 9B are two longitudinal cross-sections of the beaker shown in FIG. 6 except cup covers when dispensing a liquid into the beaker.
Figure 9A:
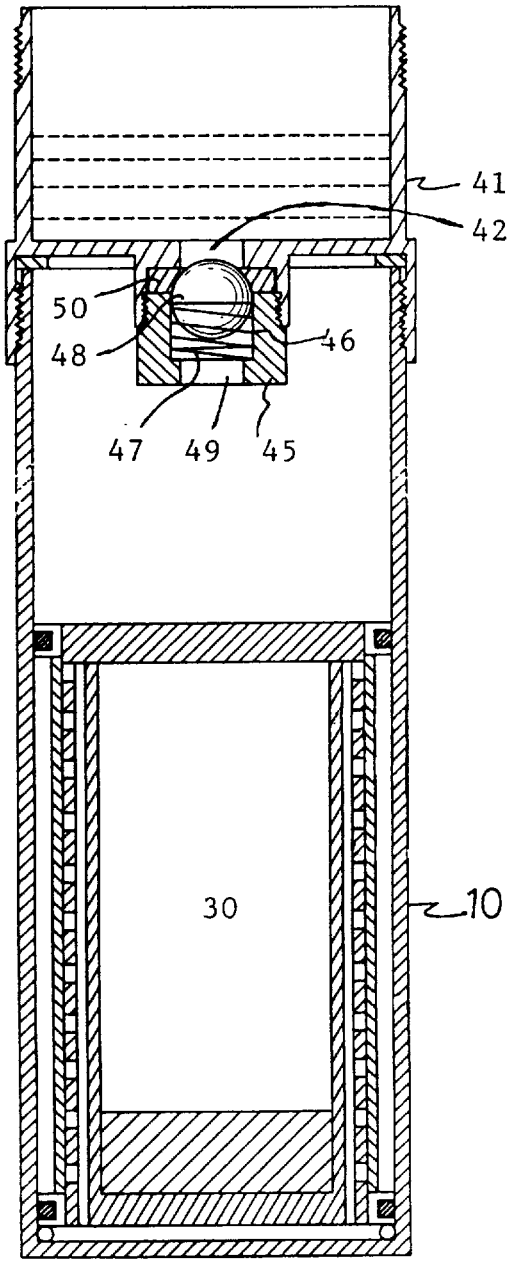

FIGS. 9A and 9B illustrate how to dispense a liquid into the beaker. The spring 47 usually pushes the steel ball 48 to seal the through hole 42 so no liquid is permitted to leak out of the cup 41. On dispensing a liquid into the beaker, the spring 47 is compressed either by a compressed gas introduced through the joint 44 installed on the top of the cup cover 43 or by a direct push from a rod 51 out of the joint 44. Thus, a liquid such as a fixing agent or the like can be introduced into the beaker in a desired manner, e.g. a certain amount at certain times.

Figure 10:
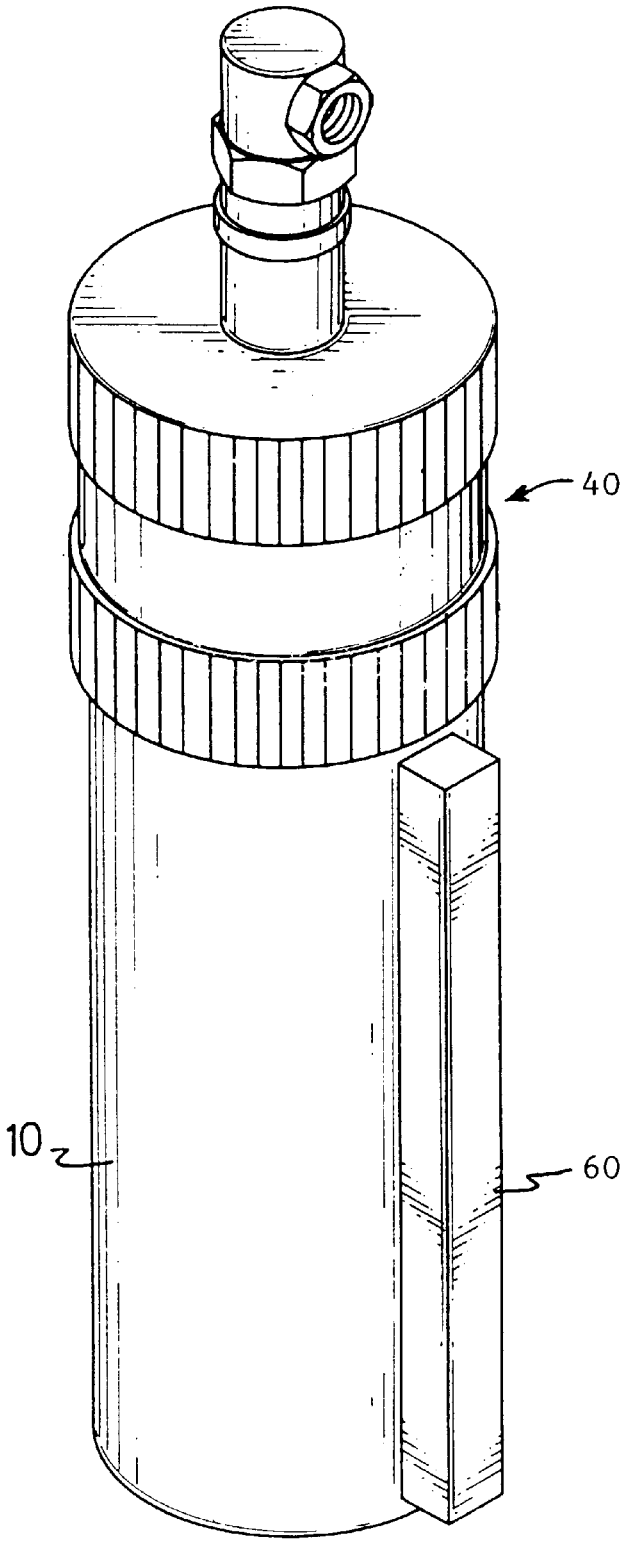
FIG. 10 is a perspective of the beaker according to one of the preferred embodiments of the present invention.
Figure 11:
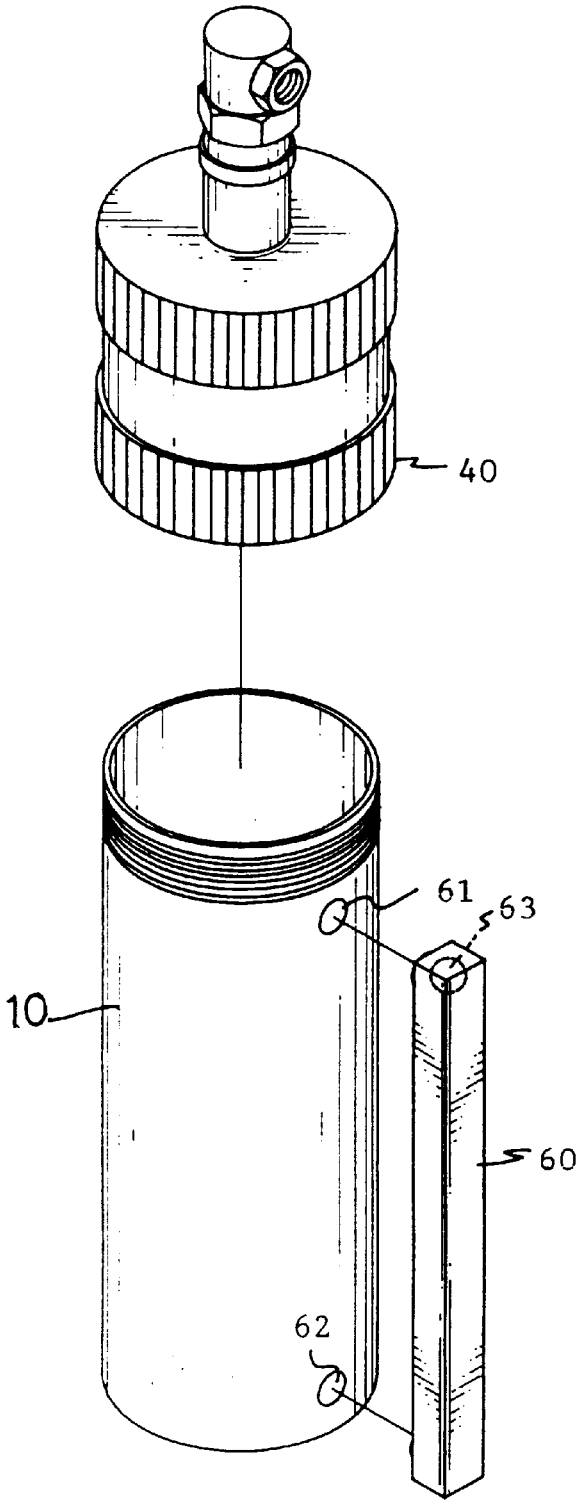
FIG. 11 is an exploded view of the beaker shown in FIG. 10.

In accordance with another one of the preferred embodiments of the present invention, the beaker for a sample dyeing machine further comprises a hollow tube 60 outside said beaker body 10 as shown in FIGS. 10 and 11. The two ends of said tube 60 are connected respectively to an upper hole 61 and a lower hole 62 formed on the outer wall of said beaker body 10. A one-way steel ball 63 is placed inside said tube 60 near the upper hole 61, in which a dye solution in the beaker body 10 can flow sequentially through the lower hole 62, the tube 60 and the upper hole 61, and re-enter the beaker body 10 after upward pushing said one-way steel ball 63 inside said tube 60.

Figure 12:
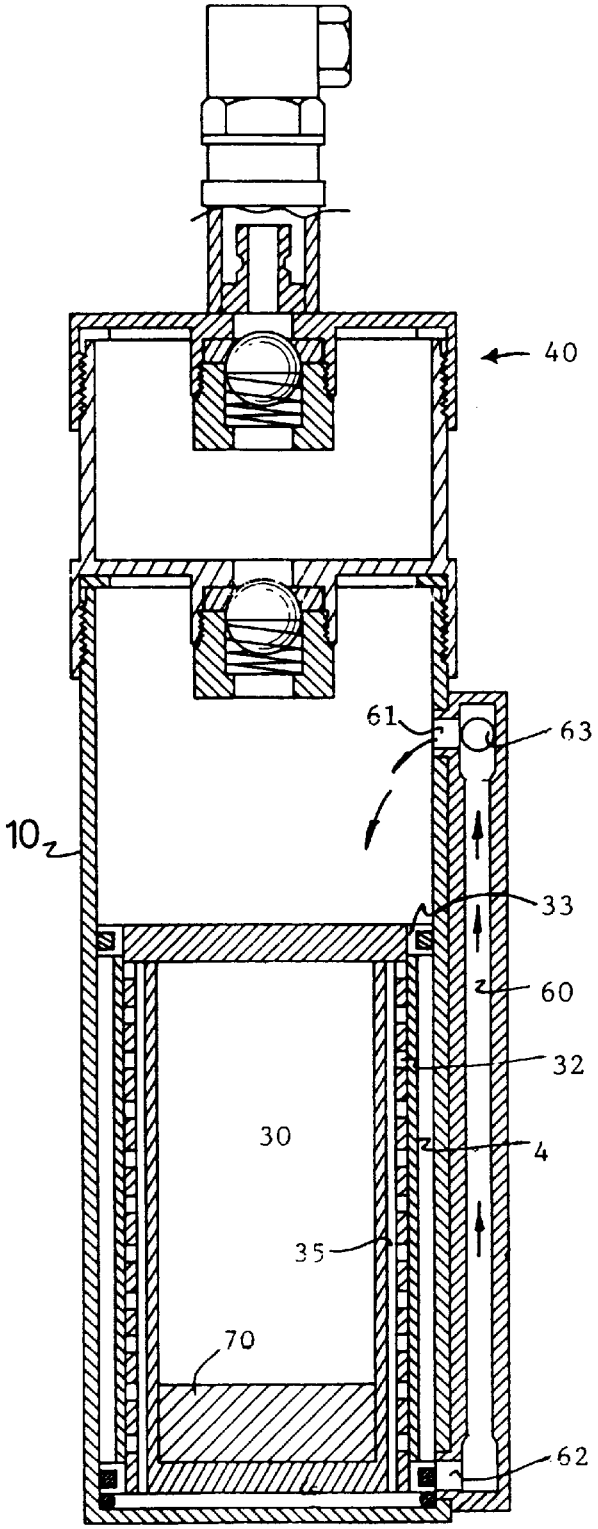
FIG. 12 is a longitudinal cross-section of the beaker shown in FIGS. 10 and 11.

FIG. 12 illustrates how a liquid can flow through the tube 60 only while the cylinder 30 is moving downward. That is, the liquid partly flows upward through the tube 60 while the cylinder 30 is moving downward. Nevertheless, it must fully flow downward through the grooves 33 to contact with the sample while the cylinder 30 is moving downward because the one-way steel ball 63 is stuck downward in the tube 60 and stops the flow. Therefore, said tube 60 can modify the circulation of a liquid in the beaker body 10 and make sure that, in conjunction with the cylinder 30, all of a liquid is passed through the sample to be dyed.

Moreover, the beaker may further comprise a protective cover to enclose said tube. In addition, the tube 60 and the protective cover may be integrated in one component of said beaker, and the steel ball 63 is placed therein.

Figure 13:
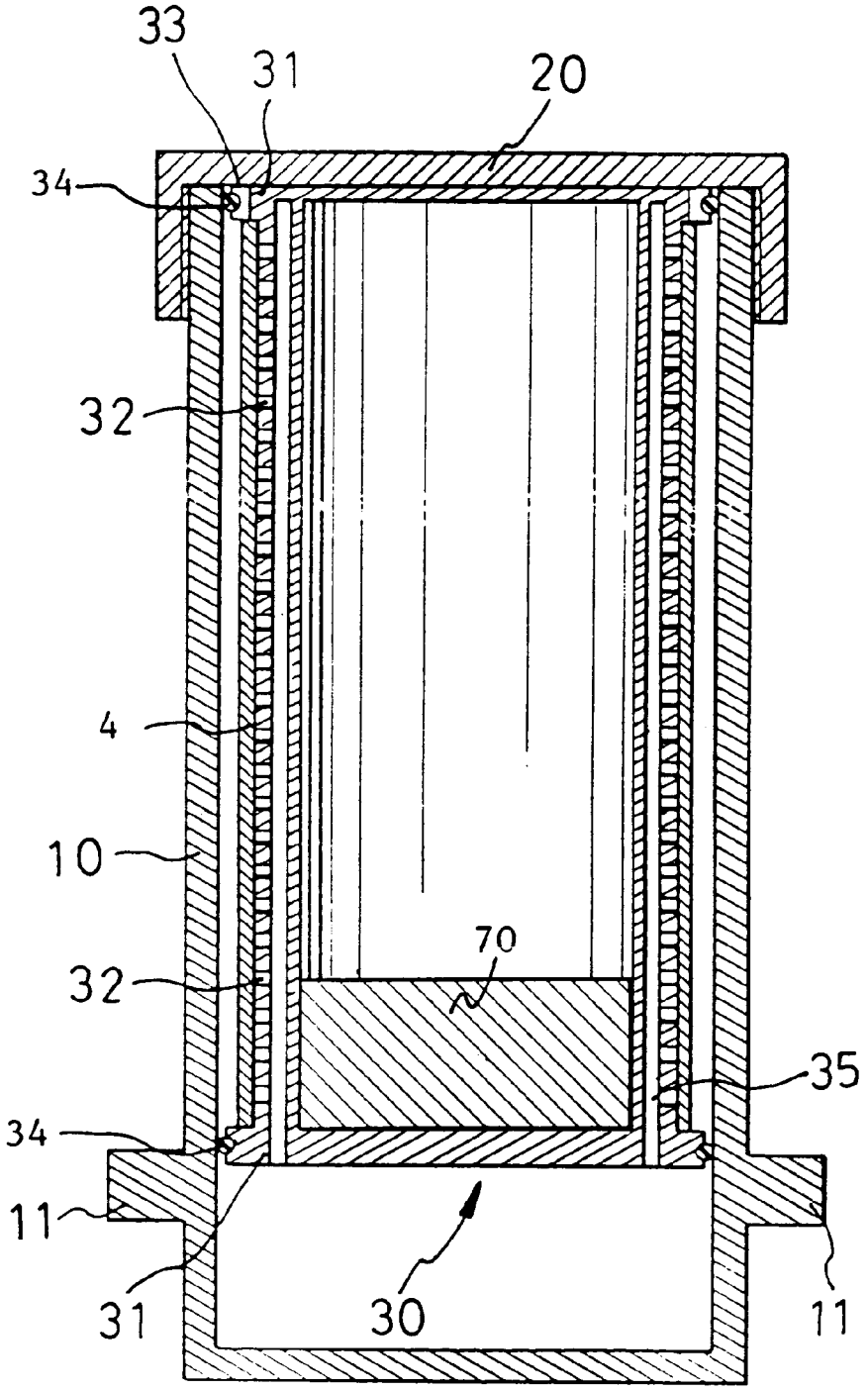
FIGS. 13 shows a longitudinal cross-sections of the beakers according to the preferred embodiments of the present invention.

Installed in a commercially available sample dyeing machine, the cylinders 30 in the aforementioned beakers can be slid by shaking or rotating. In order to be applied to the sample dyeing machine of the present invention, said cylinder 30 may further comprise a strong magnet 70 on the bottom thereof, or two strong magnets on the top and the bottom, respectively, as shown in FIG. 12 or 13. The cylinder 30 equipped with strong magnet can be easily driven by magnetic force while installed in the sample dyeing machine according to the present invention. A magnet retaining strong magnetic force at elevated temperatures under which the dyeing process is carried out is desired.

According to the preferred embodiments of the present invention, FIG. 12 illustrates a longitudinal cross-section of the beaker with the combination of most of the features mentioned above.

Figure 14:
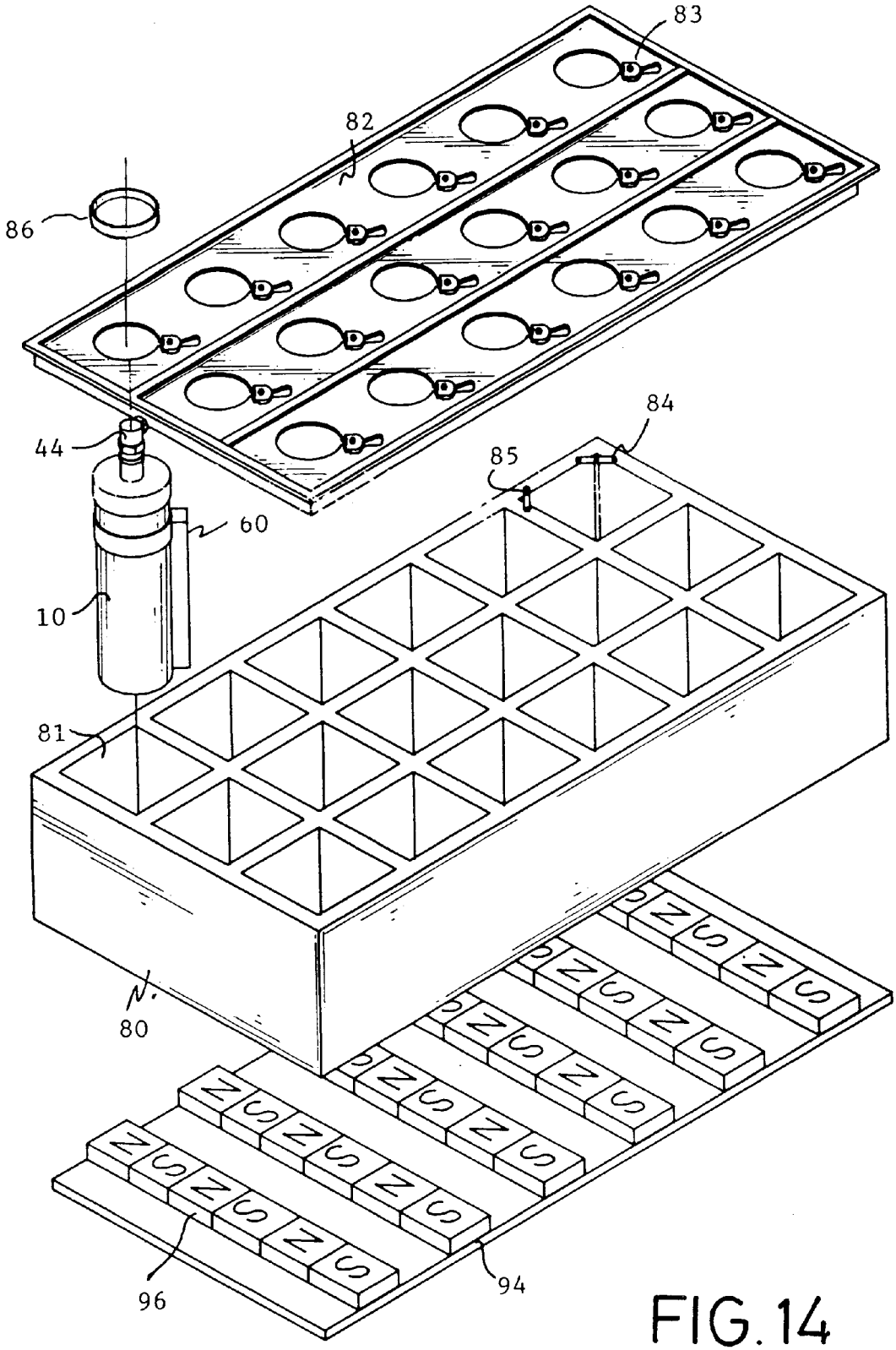
FIG. 14 is an exploded view of the upper portion of the sample dyeing machine according to one of the preferred embodiments of the present invention.
Figure 15:
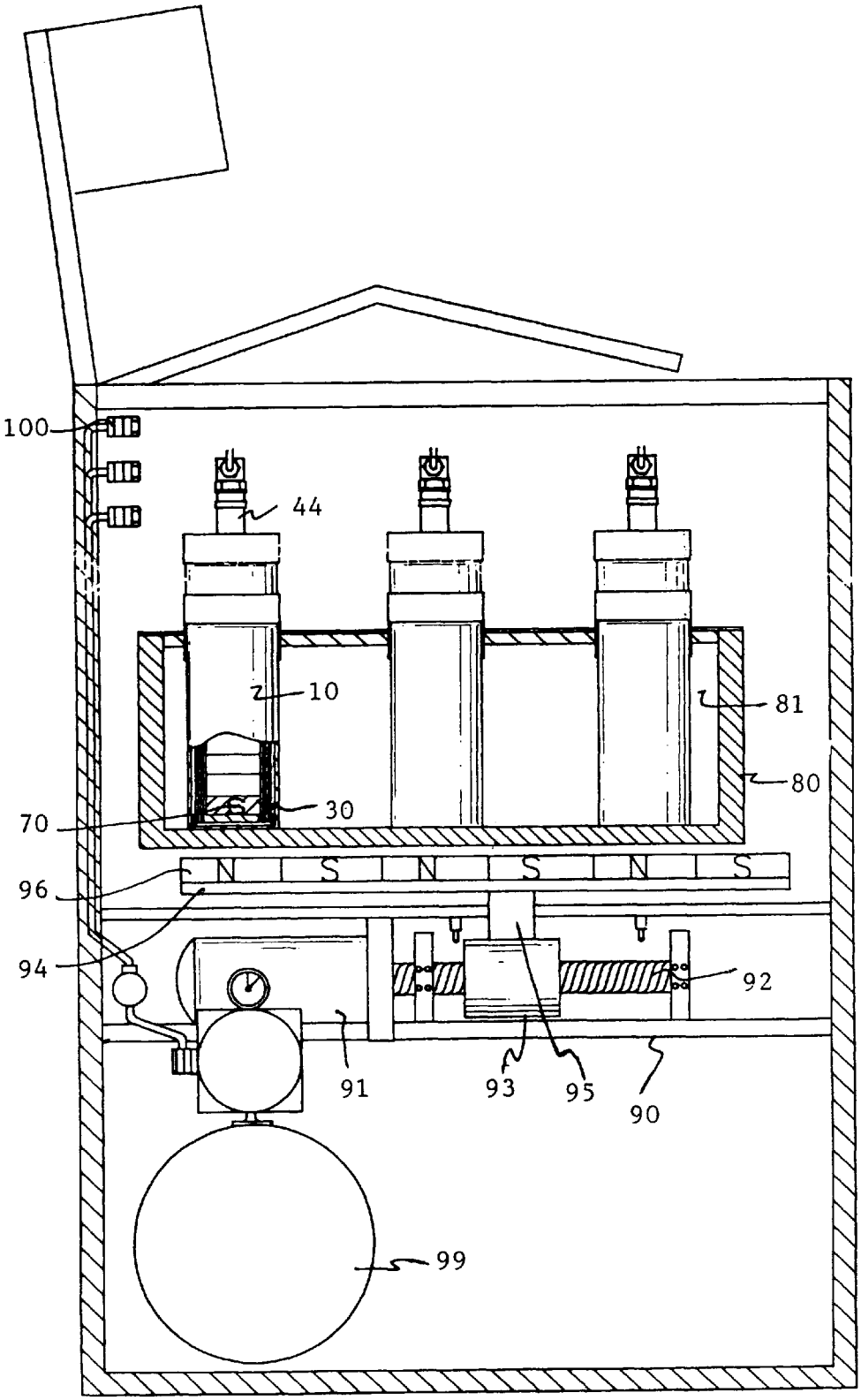
FIG. 15 shows a cross-section of the sample dyeing machine in a side view according to one of the preferred embodiments of the present invention.
Figure 16:
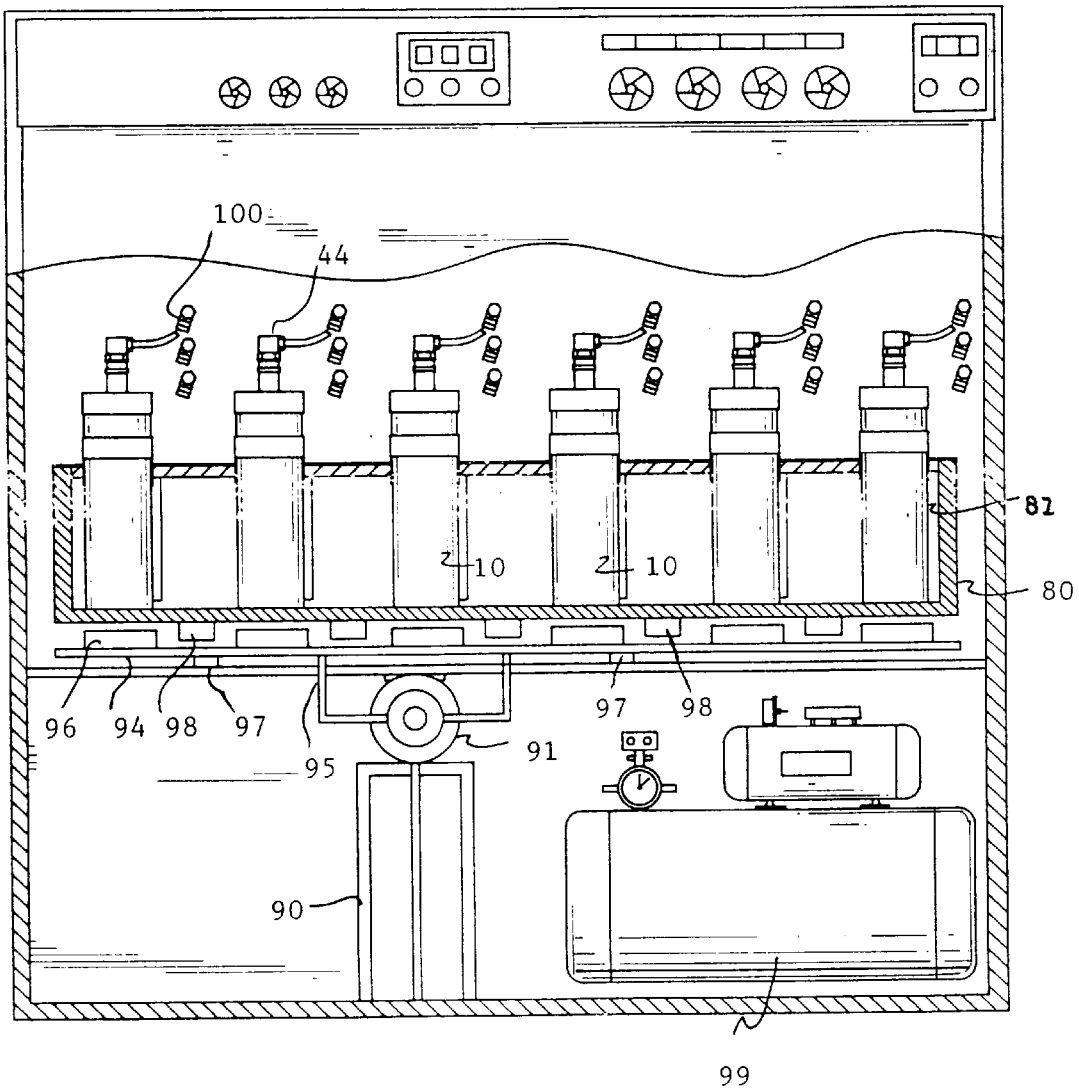
FIG. 16 shows a cross-section of the sample dyeing machine shown in FIG. 15 in a front view.

In accordance with another one of the preferred embodiments of the present invention, the sample dyeing machine illustrated in FIGS. 14 to 16 includes a plurality of beakers 10 for containing dye solutions and samples to be dyed. Each said beaker 10 contains a cylinder 30 with a strong magnet 70 on the bottom thereof. A yarn or cloth sample to be dyed is wrapped on the outer wall of said cylinder. Therefore, a beaker according to the present invention can also be applied to said sample dyeing machine.

Referring to FIG. 14, the sample dyeing machine also includes a fixed rack 80 for containing said beakers 10. A plurality of supports 81 is formed in the rack 80 to hold beakers 10 in place and in an array. The rack 80 may further comprise several ribs 98 (shown in FIG. 16) equally spaced on the bottom thereof for reinforcement. The rack may further comprise a cover plate 82 with holes corresponding to each beaker location, and a lock 83 located at the edge of each hole to firmly retain a beaker 10 in place. In addition, said support 81 of the rack 80 may further comprise a heating bar 84 and a temperature sensing rod 85 installed at the edge thereof to individually control and monitor the temperature of each beaker 10. It is desirable to form an adiabatic space in the support 81 so as to thermally control each beaker 10 with precision.

After putting the cover plate 82 on the rack 80, each beaker 10 can be put into the support 81 and locked by the lock 83. An additional annulus 86 may further encircle the top portion of the beaker 10 for fixation. Hence, it is easy to replace a beaker 10 without picking up the cover plate 82. Each of the beakers 10 may further comprise a tube 60 on the outer wall thereof as described above. The top end of said tube 60 can be as high as the top the rack 80. A joint 44 for gas introduction by pressure may also be installed on the top of the beaker 10. Thus, a liquid can be individually dispensed into the selected beaker in a desired manner without interrupting the operation of other beakers.

Referring to FIG. 15 or 16, the sample dyeing machine also includes a frame 90 horizontally installed therein, on which a motor 91 is installed, a screw 92 is connected to the front end portion of said motor 91, and a sleeve 93 encloses said screw 92 and moves back and forth along said screw 92 due to the revolution of said screw 92 when driven by the motor 91. Between the rack 80 and the frame 90, a magnetic plate 94 connected to said sleeve 93 by a connecting block 95, wherein a plurality of strong magnets 96 being so separately arranged on the plate as shown in FIG. 14 that the pole (N or S) of each magnet 96 is opposite to that of adjacent magnets. Said magnetic plate 94 is slid back and forth due to the movement of said connecting block 95. The direction of the magnetic field under each beaker 10 is thus alternated periodically. Hence, the cylinders 30 inside said beakers 10 are moved up and down by repulsive and attractive force of magnets. Accordingly, the liquid in the beakers is forced to flow and dye the sample sufficiently.

Furthermore, said magnetic plate 94 may comprise several slides 97 on the bottom thereof so that the magnetic plate 94 can slide smoothly relative to said frame 90. The sample dyeing machine may further include an air compressor 99 on the bottom thereof. Said air compressor 99 is connected with hoses equipped with connectors 100 at the end thereof for passage of compressed air therefrom to the joints 44 on the tops of beakers 10 in order to control the liquid dispensation as described above.

By fixing the beakers 10 in the supports 81 of the rack 80, it is possible to equip each of the beakers 10 with additional functions or attachments. It is advantageous that beakers 10 in the sample dyeing machine according to the present invention can run in a single mode or in a batch mode. Thus, a beaker and a sample dyeing machine with high efficiency and versatility have been achieved.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A beaker for a sample dyeing machine, comprising:

a hollow beaker body for containing a dye solution;

a cylinder with flanges on both its ends, said cylinder being slidable within said beaker body, the outer wall of said cylinder being uniformly perforated and adapted to support thereon a yarn or cloth sample to be dyed;

a plurality of grooves parallel to the longitudinal axis of said cylinder and separately formed on the periphery of either one of the flanges to permit the dye solution inside said beaker body to flow around said cylinder when the beaker is installed in a sample dyeing machine; and an annular passage formed in the interior of said cylinder from one end to the other for allowing a dye solution to flow between said passage and the perforated wall of said cylinder.

2. The beaker according to claim 1, further comprising a lid screwed to said beaker body, which can move together when installed in a sample dyeing machine.

3. The beaker according to claim 1, further comprising a set of stems on the outer wall of said beaker body for fixing the beaker in a sample dyeing machine.

4. The beaker according to claim 1, wherein each said flange of said cylinder further comprising a ring on its circumference, the ring being positioned between said flange and the inner wall of said beaker body.

5. The beaker according to claim 1, wherein the longitudinal direction of said grooves on said flange of said cylinder being tilted relative to the longitudinal axis of said cylinder.

6. The beaker according to claim 1, further comprising a dispensing device screwed into the top thereof for liquid addition to said beaker body, wherein said dispensing device comprising a cup for containing a liquid having a through hole formed in the center of its bottom, a cup cover screwed on the top of said cup, and a joint for gas introduction by pressure installed on the top of said cup cover, in which a locking block is screwed beneath the bottom of said cup, a cavity is formed at the center of said locking block, a spring and a steel ball are sequentially placed inside said cavity from bottom to top, and a recess hole is formed at the bottom of said cavity and connected with the through hole formed on the center of the cup bottom to allow a liquid to flow from said cup of said dispensing device into said beaker body.

7. The beaker according to claim 6, wherein said cup cover of said dispensing device further comprising a through hole formed on the center thereof, a locking block screwed beneath said cup cover, a cavity formed at the center of said locking block beneath said cup cover, a spring and a steel ball sequentially placed inside said cavity from bottom to top, and a recess hole formed at the bottom of said cavity and connected with said joint installed on the top of said cup cover to allow a pressurized gas to flow from said joint into said cup cover.

8. The beaker according to claim 6, wherein said dispensing device further comprising an O-ring or a washer placed between said locking block and said cup or cup cover thereof.

9. The beaker according to claim 1, further comprising a hollow tube outside said beaker body, wherein the two ends of said tube being connected respectively to an upper hole and a lower hole formed on the outer wall of said beaker body, and a one-way steel ball being placed inside said tube near the upper hole, in which a dye solution in said beaker body can flow sequentially through said lower hole, said tube and said upper hole, and re-enter said beaker body after upward pushing said one-way steel ball inside said tube.

10. The beaker according to claim 9, further comprising a protective cover to enclose said tube.

11. The beaker according to claim 10, wherein said tube and said protective cover being integrated in one component of said beaker, and said steel ball being placed therein.

12. The beaker according to claim 1, wherein said cylinder further comprising a strong magnet on the bottom thereof, which retaining strong magnetic force at elevated temperatures under which the dyeing process is carried out.

* * * * *